US012584312B2

(12) United States Patent
Douwes

(10) Patent No.: US 12,584,312 B2
(45) Date of Patent: Mar. 24, 2026

(54) WALL ELEMENT, WALL AND BUILDING AS WELL AS METHOD FOR CONSTRUCTION

(71) Applicant: Ecowand IP B.V., Nieuw-Amsterdam (NL)

(72) Inventor: Johannes Jacobus Douwes, Nieuw-Amsterdam (NL)

(73) Assignee: ECOWAND IP B.V., Nieuw-Amsterdam (NL)

( * ) Notice: Subject to any disclaimer, the term of this patent is extended or adjusted under 35 U.S.C. 154(b) by 0 days.

(21) Appl. No.: 18/872,667

(22) PCT Filed: Jun. 7, 2023

(86) PCT No.: PCT/NL2023/050315
§ 371 (c)(1),
(2) Date: Dec. 6, 2024

(87) PCT Pub. No.: WO2023/239236
PCT Pub. Date: Dec. 14, 2023

(65) Prior Publication Data

US 2025/0163698 A1 May 22, 2025

(30) Foreign Application Priority Data

Jun. 7, 2022 (NL) ..... 2032089

(51) Int. Cl.
*E04C 2/04* (2006.01)
*E04C 2/288* (2006.01)

(52) U.S. Cl.
CPC ..... *E04C 2/044* (2013.01); *E04C 2/2885* (2013.01)

(58) Field of Classification Search
CPC ..... E04C 2/044; E04C 2/2885; E04C 2/38; E04C 2/50
See application file for complete search history.

(56) References Cited

U.S. PATENT DOCUMENTS 3,228,161 A * 1/1966 Mccown ..... E04C 2/384 52/282.1
3,336,709 A * 8/1967 Berney ..... E04C 2/384 52/309.3
3,484,999 A * 12/1969 Van Der Lely ..... E04B 1/62 52/79.14

(Continued)

FOREIGN PATENT DOCUMENTS

EP 0381000 4/1993
RU 2092662 10/1997

*Primary Examiner* — Gisele D Ford
(74) *Attorney, Agent, or Firm* — MH2 Technology Law Group, LLP

(57) ABSTRACT

Wall element for manufacturing a wall of a building, comprising: a substantially planar shell (4) having a peripheral edge, the shell comprising casting mortar (G); one or more profiles (14, 16) at least partially embedded in the shell (4) and provided with at least one joining surface positioned outside the shell when viewed from a shell surface, each of the profiles (14, 16) being provided with a respective connection surface (24, 26); and at least one pressure-reducing element (30, 32) operatively connected to at least a part of the one or more profiles. The invention relates also to a wall and/or a building built up of such wall plates and a method for manufacturing a wall element.

16 Claims, 4 Drawing Sheets

(56) References Cited

Figure 1A:
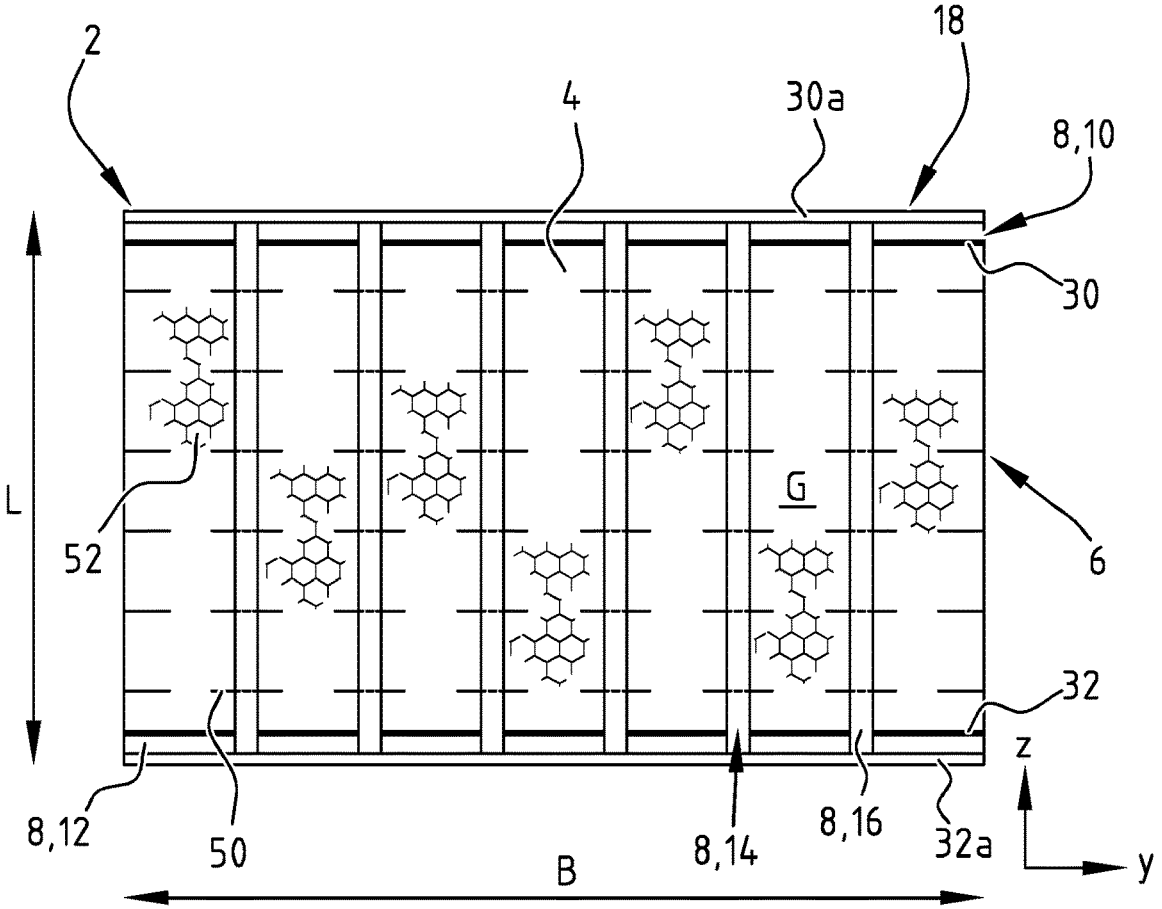

U.S. PATENT DOCUMENTS 3,886,648 A * 6/1975 Kahn ..... E04C 2/06 29/469
4,442,648 A * 4/1984 Reece ..... E04B 5/023 52/471
4,624,089 A * 11/1986 Dunker ..... E04C 2/06 52/712
4,649,682 A * 3/1987 Barrett, Jr. ..... E04C 2/044 174/480
4,909,007 A * 3/1990 Bodnar ..... E04B 5/29 52/634
5,207,045 A * 5/1993 Bodnar ..... E04C 2/384 52/635
5,526,629 A * 6/1996 Cavaness ..... E04C 2/384 52/630
5,758,463 A * 6/1998 Mancini, Jr. ..... E04C 2/384 52/309.7
6,230,409 B1 * 5/2001 Billings ..... E04C 2/288 29/897.3
6,460,301 B1 * 10/2002 McKee ..... E04C 2/384 52/235
6,543,371 B1 * 4/2003 Gardner ..... E04C 2/384 109/83
6,729,094 B1 * 5/2004 Spencer ..... E04B 5/10 52/354
7,681,368 B1 3/2010 Rubio
11,352,780 B2 * 6/2022 Foster ..... E04C 2/049
2002/0069602 A1 * 6/2002 Blanchet ..... E04H 9/14 52/745.1
2003/0014935 A1 * 1/2003 Bodnar ..... E04C 2/384 428/595
2004/0182041 A1 * 9/2004 Bodnar ..... E04C 3/083 52/481.1
2006/0075701 A1 * 4/2006 Cretti ..... B62D 33/04 52/223.8
2006/0075707 A1 * 4/2006 Cretti ..... E04B 5/04 52/414
2006/0191232 A1 * 8/2006 Salazar ..... E04C 2/044 52/606
2009/0199493 A1 * 8/2009 Kintscher ..... E04G 21/125 52/122.1
2009/0217612 A1 9/2009 Window
2009/0293395 A1 * 12/2009 Porter ..... E04B 7/04 52/579
2011/0061329 A1 * 3/2011 Tadros ..... E04C 2/044 52/794.1
2011/0083386 A1 * 4/2011 Keller ..... E04B 5/16 52/309.13
2011/0268912 A1 * 11/2011 Bowman ..... E04C 2/044 428/99
2012/0247055 A1 * 10/2012 Lawley ..... E04B 5/10 52/655.1
2013/0081345 A1 * 4/2013 Sheehy ..... E04C 2/288 52/425
2014/0141160 A1 * 5/2014 Strachan ..... B05D 7/50 427/209
2014/0144102 A1 * 5/2014 Chen ..... E04C 2/243 428/223
2017/0022700 A1 * 1/2017 Clark, Jr. ..... E02D 29/14

* cited by examiner

WALL ELEMENT, WALL AND BUILDING AS WELL AS METHOD FOR CONSTRUCTION

The invention relates to a wall plate for manufacturing a wall, a wall constructed from such wall plates and a method for realizing a wall.

Known in practice are prefab walls for constructing buildings, which are utilized to speed up the construction process. For this purpose use is made of, among other things, concrete elements which are made to measure in a factory and can be assembled on site.

A drawback of the known wall elements is that the reusability, and thereby the sustainability, of such elements is relatively limited. In addition, a relatively large amount of energy is needed to produce such concrete walls.

The object of the invention is to obviate or at least reduce the above stated drawbacks by providing an improved wall element.

The invention provides for this purpose a wall element for manufacturing a wall of a structure, comprising:

- a substantially plane-like layer with a peripheral edge, wherein the layer comprises casting mortar;
- one or more profiles which are at least partially embedded in the layer and which are provided with at least one connecting surface which, when viewed from a layer surface, is positioned outside the layer; and
- at least one pressure reducing element which is operatively connected to at least a part of the one or more profiles.

An advantage of the wall element according to the invention is that, due to the use of casting mortar with one or more profiles, a light wall element is realized, particularly compared to concrete and wooden wall elements. This makes the costs and the environmental impact of transporting the wall elements relatively low.

A further advantage is that the wall elements can be manufactured in a factory, whereby they can be realized in efficient manner.

Yet another advantage is that the wall elements according to the invention are almost fully recyclable, which means that the carbon footprint of the elements is very low or even close to zero.

An advantage of the pressure reducing element is that it absorbs pressure differences caused by differences in the expansion coefficients between the casting mortar of the layer and the profiles in simple manner. Damage to the element due to such expansion differences are hereby substantially prevented. Absorbing the pressure differences is in many cases realized by the pressure reducing element being deformable (and usually compressible), thus allowing it to be compressed under said pressure differences in order to reduce the pressure. Solutions other than deformability which result in pressure reduction are of course also applicable.

It is noted that, due to the use of casting mortar, the layer is very rigid and has a low expansion coefficient. The profiles generally have an expansion coefficient which is higher than that of the layer. Due to the connection of the layer to the one or more profiles, in the event of a temperature change stress may occur, particularly at the point where different profiles connect to each other (so come into contact with or are connected to each other), which is transferred to the layer. Arranging a pressure reducing element between the different profiles at the positions where they connect to each other ensures that the stresses are absorbed and damage is substantially prevented.

An advantage of the wall element according to the invention is that the construction of the wall element requires only a limited number of profiles, without making or having to make concessions to the load-bearing capacity and/or strength of the wall element and a wall constructed therefrom. A reduction in material can hereby be achieved.

In an embodiment of the wall element according to the invention the casting mortar can be a composition on the basis of anhydrite, wherein the composition preferably further comprises at least gypsum, sand and water.

An advantage of anhydrite-based casting mortar is that such casting mortar is much lighter than concrete and has a higher strength. A further advantage is that such a casting mortar is almost wholly reusable when removed.

In an embodiment of the wall element according to the invention the one or more profiles can comprise a plurality of profiles.

An advantage of using a plurality of profiles is that the profiles can be adapted to the position and orientation in the wall element. This realizes a high degree of flexibility in the manufacture.

A further advantage is that diverse forms and dimensions of the wall element can be manufactured if use is made of a plurality of profiles.

In a further development a part of the profiles can be applied in order to form a frame which extends along the peripheral edge, or at least in the direct vicinity thereof. The phrase 'direct vicinity' must be understood here to mean 'immediately adjacently' and/or within a predetermined distance from the peripheral edge of the layer, wherein the determined distance can be within the range of less than 5% of the length and/or width, preferably less than 3% of the length and/or width and more preferably in the range of less than 2% of the length and/or width of the wall element.

In an embodiment of the wall element according to the invention the wall element can comprise a plurality of profiles, wherein a first sub-group of profiles are longitudinal profiles which extend over at least a part of a length of the wall element and wherein a second sub-group of profiles are transverse profiles which extend over at least a part of a width of the wall element.

Preferably, the longitudinal profiles extend over substantially the whole length of the wall element and/or the transverse profiles extend over substantially the whole width of the wall element.

An advantage of this embodiment is that longitudinal and transverse profiles, these together forming a frame for the wall element, can be arranged on or in the direct vicinity of the peripheral edge. If desired, further longitudinal or transverse profiles can be arranged in the frame formed therewith for further support.

The terms longitudinal and transverse profile and the directions represented thereby should otherwise be deemed indicative, since the length and width of the wall element may vary. These indications are therefore intended only to indicate a relative direction and/or position. The longitudinal and transverse profiles lie relative to each other at an angle which is more than zero.

It is preferably the case that two transverse profiles are applied close to the peripheral edge, preferably the upper and the lower edge of the periphery of the wall element. The number of longitudinal profiles is adapted to a width of the wall element and is a minimum of two longitudinal profiles (which are placed close to the peripheral edge). It is of course also possible however to have two longitudinal profiles and a number of transverse profiles which is adapted to the length of the wall element.

In an embodiment of the wall element according to the invention the pressure reducing element can be arranged between the longitudinal profiles and the transverse profiles, and preferably at a position where the longitudinal profiles and the transverse profiles connect to each other, come into contact with each other or are connected to each other.

An advantage of this embodiment is that the pressure reducing element is able to absorb the warping of the longitudinal and transverse profiles relative to each other and so remove any stresses caused by the differences in expansion coefficient between the layer, particularly the casting mortar, and the profiles.

It is preferably the case that a pressure reducing element is located at each connection of a transverse profile and a longitudinal profile. Due to the use of casting mortar, the layer is very rigid and has a low expansion coefficient. The profiles have an expansion coefficient which is higher than that of the layer. Because the layer is connected to the profiles, in the event of temperature change stress may occur, particularly at the point where the transverse and longitudinal profiles connect to each other (and therefore come into contact with each other). Arranging a pressure reducing element at these positions ensures that these stresses are absorbed.

In an embodiment of the wall element according to the invention the wall element can further comprise one or more upright elements, wherein each upright element is associated with a profile and extends along the at least one connecting surface thereof.

An advantage of applying uprights is that any thickness of the wall can in principle be realized. This is because the thickness of the uprights also determines the final thickness of the wall. The uprights are preferably arranged in a length (or height) direction of the wall element and connected to a floor and/or storey floor for placing of the wall.

A further advantage of applying uprights is that a space remains between the uprights which, if desired, can be filled with (additional) insulating material.

It is noted that the uprights can be manufactured from any suitable material. Materials suitable for this purpose include metals, preferably galvanized steel or stainless steel, wood and/or wood-like materials.

It is otherwise the case that, due to said limited number of profiles needed, the amount of uprights is also limited, particularly relative to for instance traditional wood-frame construction.

In an embodiment of the wall element according to the invention a pressure reducing element can be arranged between a connection of the uprights connected to the longitudinal profiles and the transverse profiles.

In the event that use is made of uprights it may be advantageous to (also) arrange a pressure reducing element between the uprights and the transverse profiles in order to absorb the warping of the uprights and the transverse profiles relative to each other and to prevent any stress in the layer. This is particularly important if the uprights substantially connect to the transverse profiles.

In an embodiment of the wall element according to the invention the at least one pressure reducing element can be an elastic element, preferably a rubber element and more preferably a rubber band.

An advantage of an elastic strengthening element, preferably more elastic than the casting mortar and/or the profiles, is that it is highly suitable for absorbing pressure differences due to expansion. It has been found that rubber, particularly a rubber band, is highly suitable for this purpose.

In an embodiment of the wall element according to the invention the layer can further comprise a strengthening element which extends in the casting mortar.

An advantage of the strengthening element is that the strength of the layer is increased (still) further thereby.

A further advantage is that the strengthening element forms during manufacture an additional base to which the casting mortar can adhere.

In a further embodiment of the wall element according to the invention the strengthening element can be a strengthening element cast into the casting mortar of the layer.

In an embodiment of the wall element according to the invention the strengthening element can be a grating or mesh.

An advantage of a grating or mesh is that the casting mortar can easily flow around and through the grating or mesh during casting. A good connection between the strengthening element and the casting mortar is achieved thereby.

In an embodiment of the wall element according to the invention the strengthening element can be manufactured from plastic, preferably a rigid plastic, or from metal, preferably steel, more preferably stainless steel.

An advantage of said materials is that these materials are sufficiently rigid to be able to provide a good strengthening.

A further advantage is that said materials, particularly plastic, are relatively inexpensive.

A specific advantage of metal is that it is more easily recyclable than plastic.

In an embodiment of the wall element according to the invention the wall element can further comprise a reinforcement which extends at least partially in the layer and which is connected to at least a part of the profiles or is incorporated at least partially therein.

An advantage of incorporating reinforcement is that a good connection between the profiles and the casting mortar is achieved. This increases the strength of the wall element (even) further.

In an embodiment of the wall element according to the invention the reinforcement extends substantially in the casting mortar. An advantage of incorporating the reinforcement substantially wholly in the casting mortar is that damage to the reinforcement is prevented, and that the connection between the reinforcement and the casting mortar is as complete as possible.

The reinforcement is then preferably connected to the part of the profiles incorporated in the casting mortar.

In an embodiment of the wall element according to the invention the reinforcement can be formed by rod-like elements which preferably extend substantially perpendicularly of a longitudinal direction of the profiles.

An advantage of this embodiment is that, due to their cylindrical form, rod-like elements form a strong connection to the casting mortar.

A further advantage is that rod-like reinforcing elements are easily connectable to the profiles, for instance by inserting the rod-like elements through the associated openings in the profiles.

Yet another advantage of this embodiment is that a high degree of stability is achieved due to the substantially right angle of the reinforcement and the profile.

In an embodiment of the wall element according to the invention at least a part of the profiles is provided with openings and the reinforcement extends through the openings of the profiles.

By inserting the reinforcing elements through openings in the profiles a reliable, simple and strong connection of the reinforcing elements to the profiles is achieved.

A further advantage is that displacing or sliding of the reinforcing elements in the depth direction, especially during manufacture of the wall element, is substantially prevented.

In an embodiment of the wall element according to the invention the reinforcement can be connected to the strengthening element.

An advantage of said connection is that a rigid structure is formed whereby a wall element with a high strength is achieved.

A further advantage is that, particularly during manufacture, said connection provides for a good base for the attachment to the casting mortar.

In an embodiment of the wall element according to the invention the connecting surface can have a shaped profile or the connecting surface can be provided with a central recess in which the upright is placeable.

An advantage of said embodiment is that the connecting surface, and thereby the upright placeable therein, does not come into contact with the casting mortar. Moisture absorption from the casting mortar by the upright is hereby substantially prevented. This results in any damage to the upright due to moisture being prevented, particularly if use is made of a wooden upright.

In an embodiment of the wall element according to the invention a minimum of 70%, preferably a minimum of 80%, more preferably a minimum of 90% and most preferably a minimum of 95% of the material of the wall element is recyclable or reusable.

In an embodiment of the wall element according to the invention the element can further comprise:

- a second substantially plane-like layer with one or more side edges which extends substantially parallel to the first layer, wherein the second layer comprises casting mortar;
- one or more profiles which are at least partially embedded in the second layer and which are provided with at least one connecting surface which is positioned outside the plane-like surface of the second layer; and
- at least one pressure reducing element which is operatively connected to at least a part of the one or more profiles.

On a side lying opposite the layer, the wall element according to the invention can be finished in diverse ways. Use can for instance be made for this purpose of wood, gypsum or another material.

An advantage of manufacturing a second layer which is in principle the same as the first layer in respect of construction is that a light wall element with a (very) high load-bearing capacity is realized.

A further advantage is that the wall element has a high degree of recyclability, because the second layer is (also) almost wholly recyclable.

In an embodiment of the wall element according to the invention the wall element comprises one profile which is embedded in the layer directly adjacently of the peripheral edge and which extends along the whole periphery of the layer.

An advantage of a single profile which extends substantially along the whole peripheral edge is that the wall element can be manufactured in simple manner.

A further advantage is that the rigidity of the construction increases, especially if the single profile is integrally formed.

The profile is preferably provided with an integrally arranged pressure reducing element. An advantage hereof is that stresses in the material, mainly in the height direction of a wall element, can be substantially absorbed by the pressure reducing element.

It is noted that the wall element according to the invention can also be embodied without application of the pressure reducing element. Reinforcement and/or a strengthening grating is in that case however preferably used in the layer. Such an embodiment without use of the pressure reducing element can otherwise be freely combined with the other embodiments as described in the present application. This use is suitable inter alia for inner walls of a building.

The invention further relates to a wall comprising a number of wall elements according to the invention.

The wall according to the invention has similar effects and advantages as the wall element according to the invention. It is noted that the embodiments described for the wall element can also be applied, alone or in combinations, for the wall according to the invention. It is noted that wall elements according to different above described embodiments can also be combined with each other in the wall according to the invention.

The invention further relates to a building comprising a number of walls according to the invention.

The building according to the invention has similar effects and advantages as the wall element and the wall according to the invention. It is noted that the embodiments described for the wall element and/or the wall can also be applied, alone or in combinations, for the building according to the invention. It is noted that wall elements and/or walls according to different above described embodiments can also be combined with each other in the building according to the invention. An advantage of the building according to the invention is that such a building achieves a high degree of sustainability due to the use of wall elements according to the invention. This is also due to the high degree of recyclability of the wall element.

The invention further relates to a method for manufacturing a wall element according to the invention, the method comprising of:

- providing a number of profiles;
- connecting the profiles in order to form a frame;
- arranging at least one pressure reducing element between the profiles during the connecting; and
- pouring casting mortar in order to form a layer, wherein the profiles of the frame are at least partially embedded in the layer and are provided with at least one connecting surface which, when viewed from a layer surface, is positioned outside the layer.

The method for manufacturing a wall element according to the invention has similar effects and advantages as the wall element, the wall and the building according to the invention. It is noted that the embodiments described for the wall element and/or the wall and/or the building can also be applied, alone or in combinations, for the building according to the invention. It is noted that wall elements and/or walls and/or the building according to different above described embodiments can also be combined with each other in the method according to the invention.

In an embodiment of the method for manufacturing the step of arranging at least one pressure reducing element can comprise of arranging such that pressure differences between the casting mortar of the layer and the profiles, preferably pressure differences caused by differences in expansion coefficient between the casting mortar and the profiles, are absorbed.

An advantage of this embodiment is that the pressure caused by, often thermal, expansion is largely absorbed by the pressure reducing element. This element is formed such that it is compressible under a pressure caused by the expansion of the associated profile. This reduces the stress in the material by the compression of the pressure reducing element.

In an embodiment of the method for manufacturing the step of providing the profiles can comprise the step of manufacturing profiles from steel, preferably stainless steel.

An advantage of the use of steel profiles is that steel has a high load-bearing capacity and lifespan. A further advantage is that steel is reusable, this contributing to the reduction of the $CO_2$ footprint of the wall element according to the invention.

In an embodiment of the method for manufacturing the method can further comprise the step of arranging additional profiles prior to pouring of the casting mortar.

In an embodiment of the method for manufacturing the method can further comprise one or more of the steps of:

arranging a strengthening element in the layer;

arranging reinforcement in the layer, wherein the arranging comprises of connecting the reinforcement to the profiles and/or the strengthening element prior to the pouring;

connecting one or more upright elements to the connecting surfaces.

The invention further relates to a method for constructing a prefab building, the method comprising the steps of:

providing a plurality of wall elements according to the invention or a number of walls according to the invention;

placing the wall elements or walls on a floor or foundation;

placing a roof construction.

The method for constructing a prefab building according to the invention has similar effects and advantages as the wall element, the wall and the building according to the invention. It is noted that the embodiments described for the wall element and/or the wall and/or the building can also be applied, alone or in combinations, for the building according to the invention. It is noted that wall elements and/or walls and/or the building according to different above described embodiments can also be combined with each other in the method according to the invention.

An advantage of said method is that a sustainable building can be realized, particularly in respect of its recyclability and/or reusability.

A further advantage is that the building can be realized in relatively short time because the wall elements can be prefabricated.

In an embodiment of the method according to the invention the method can further comprise one or more of the steps of:

placing a storey floor and placing wall elements or walls on the storey floor in order to form a storey;

directing the layer toward the outer side of the building prior to placing if the wall to be formed forms an outer wall of the building;

providing a second layer which is directed toward an inner side of the building to be constructed and which extends parallel to the first layer, and which is connected to the one or more profiles or, alternatively, to the one or more uprights;

arranging insulating material and/or a moisture-proof and/or moisture-regulating layer against the layer on the side of the at least one connecting surface of the one or more profiles.

The method according to the invention can be further expanded with different steps, including arranging insulation, a second (preferably inward-directed) layer and/or storey floors.

The above stated steps, which can be performed as individual embodiments, show the flexibility and versatility of the method according to the invention in more detail on the basis of the wall elements according to the invention.

Figure 1B:
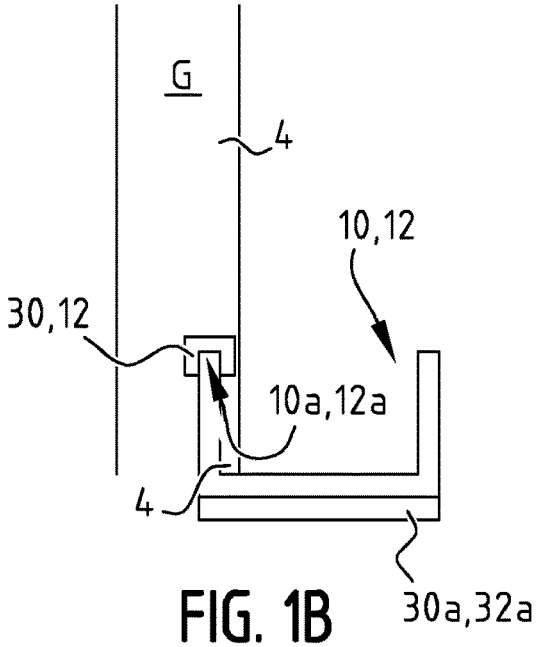
Figure 1C:
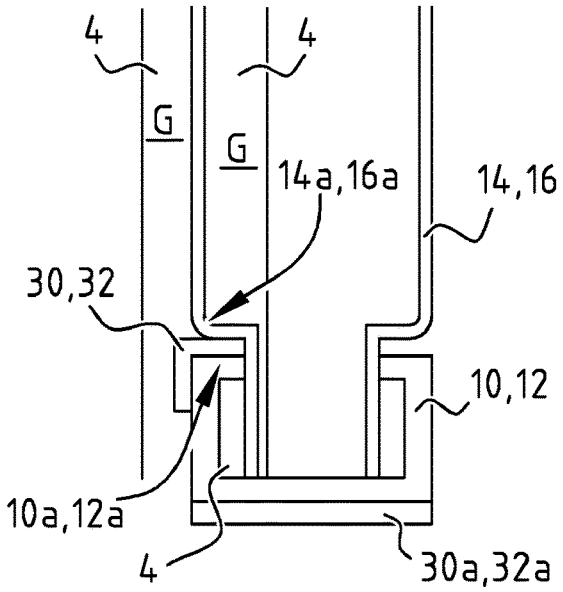
Figure 2:
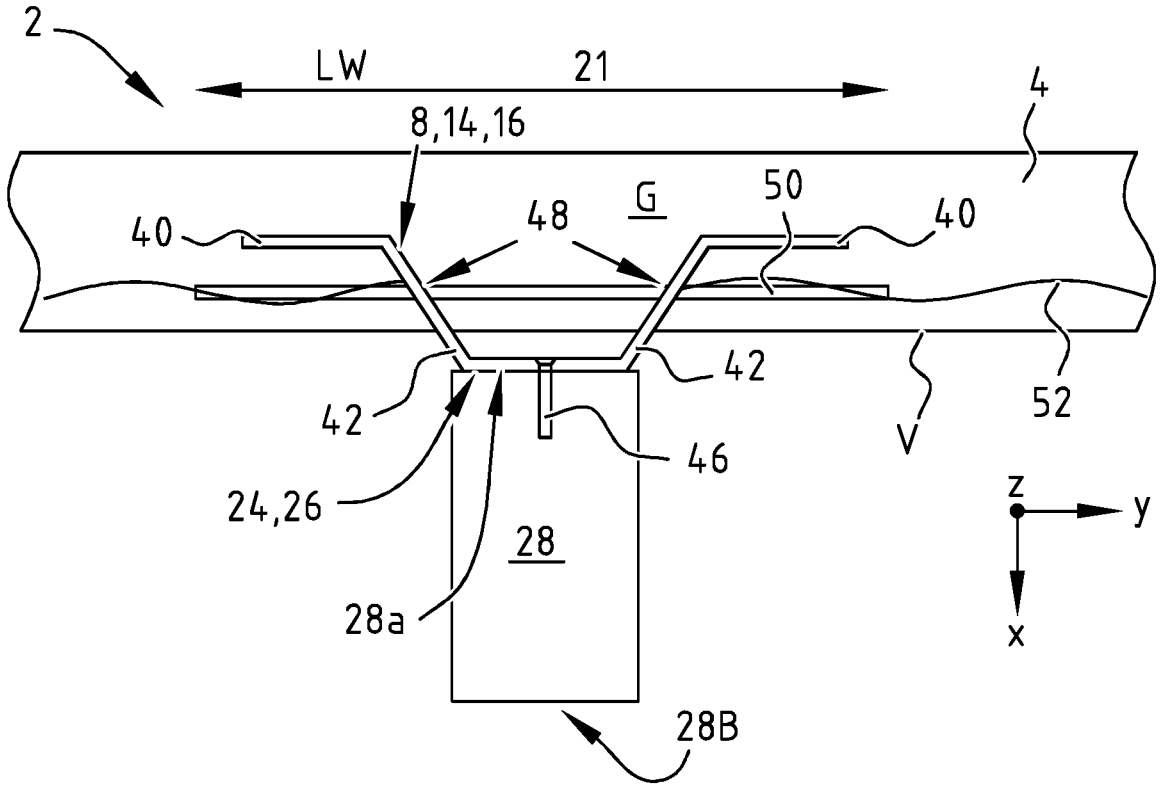
Figure 3A:
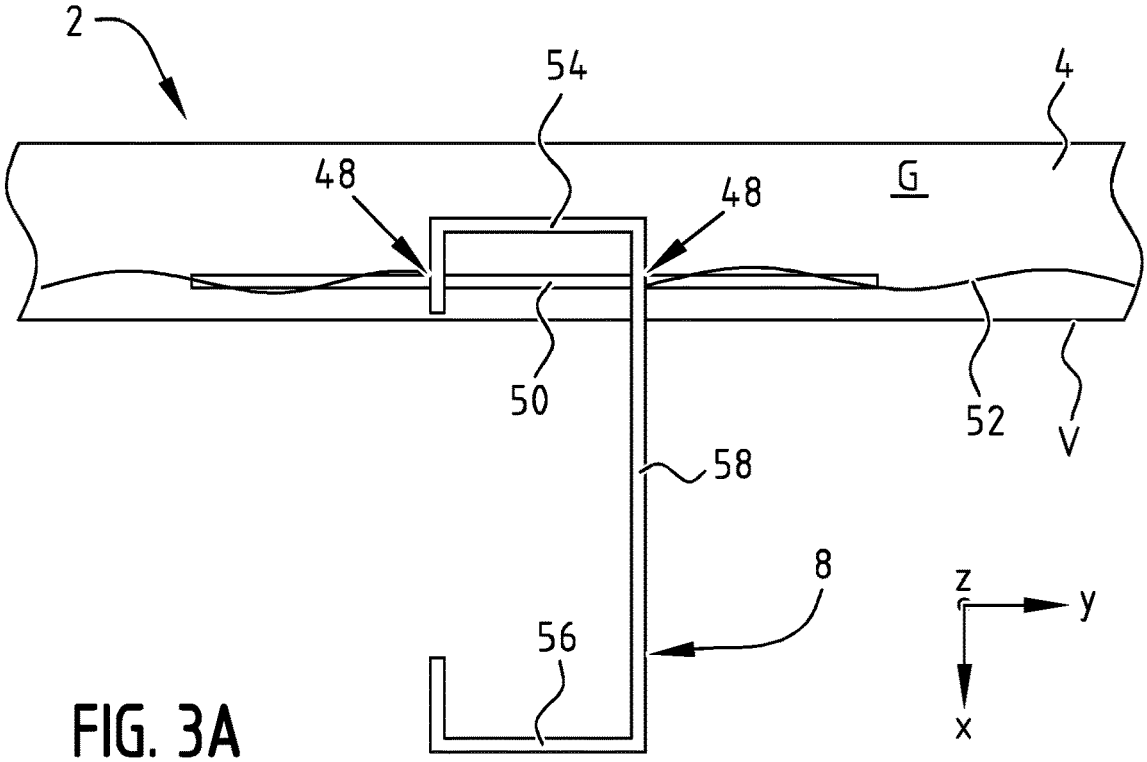
Figure 3B:
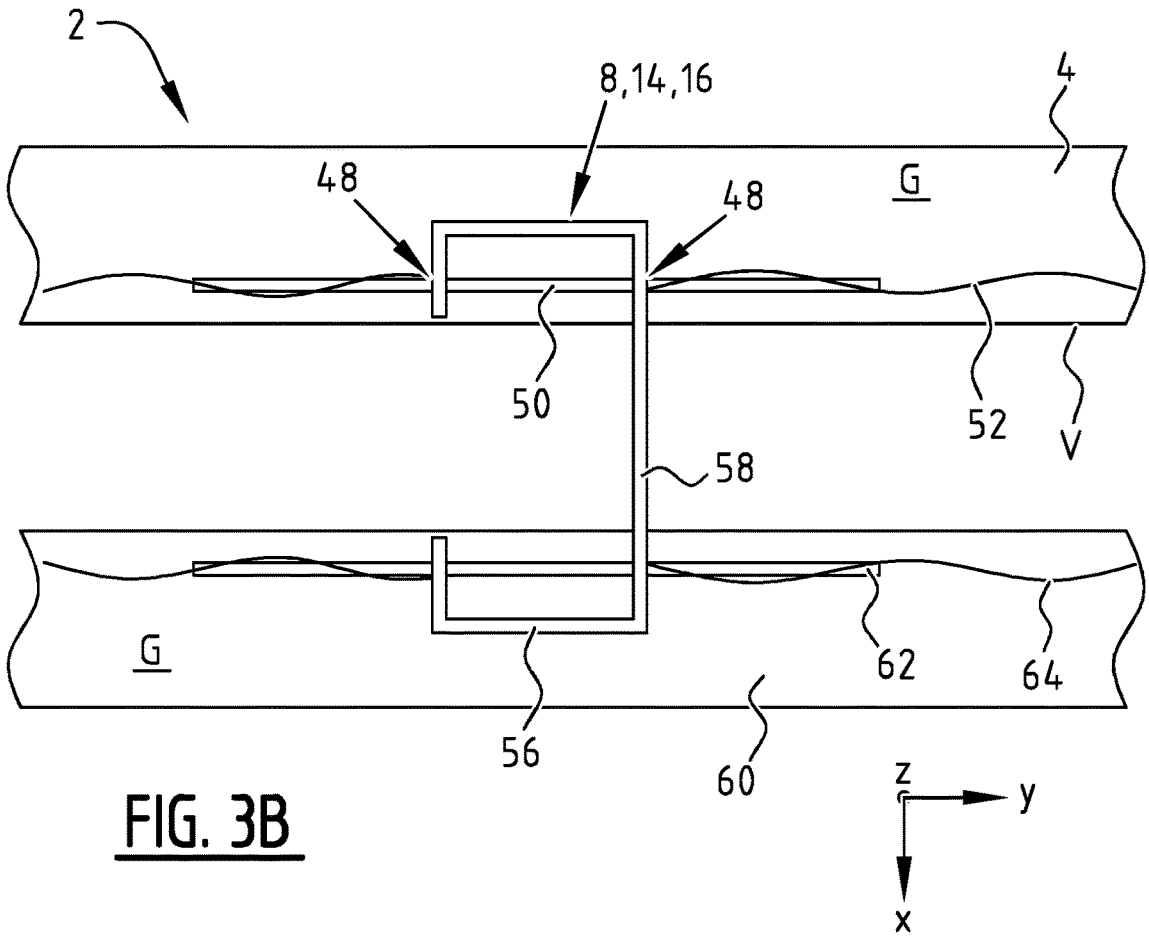
Figure 4:
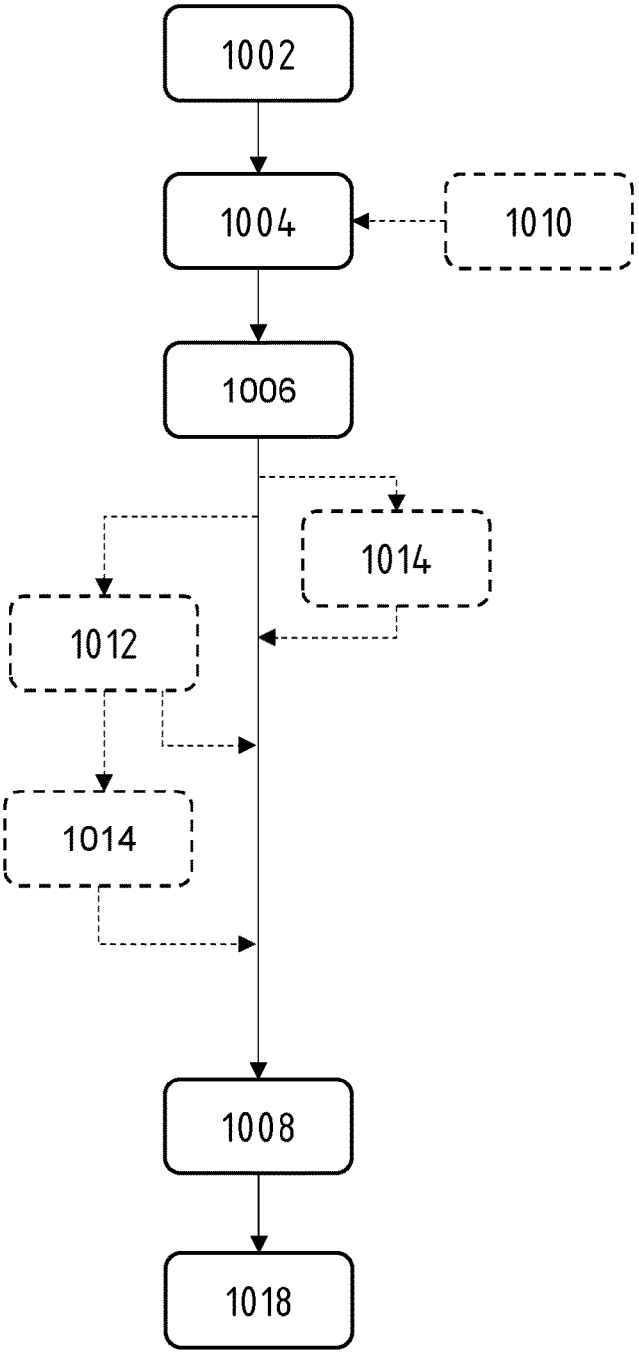
Figure 5:
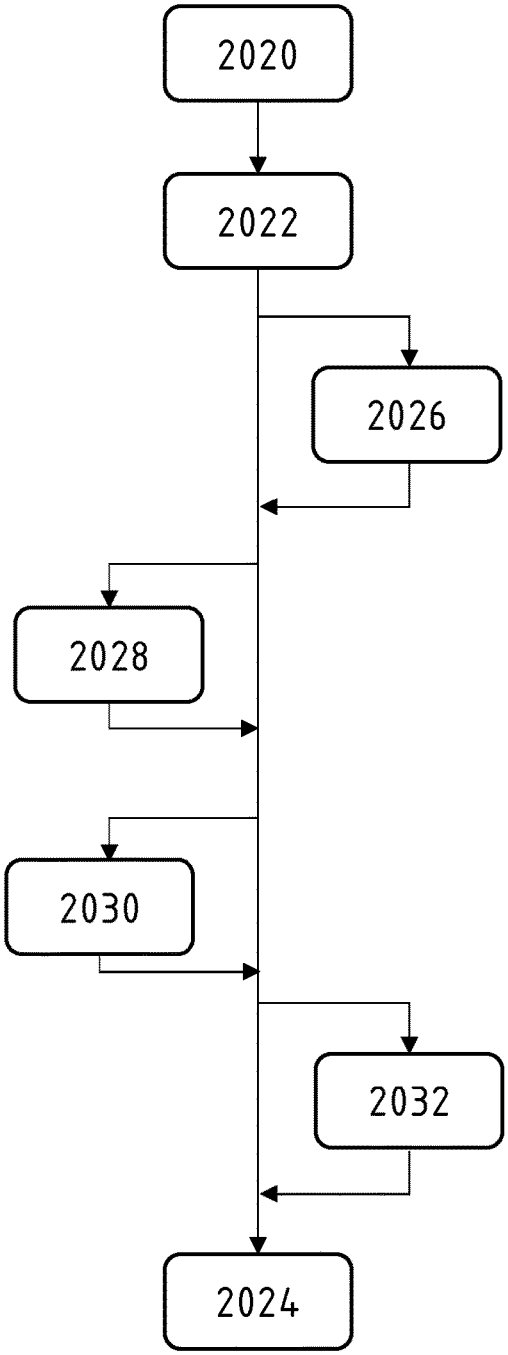

Further advantages, features and details of the invention are elucidated on the basis of preferred embodiments thereof, wherein reference is made to the accompanying drawings, in which:

FIGS. 1*a*-1*c* show cross-sectional views of embodiments of a wall element according to the invention;

FIG. 2 shows a detail view of an embodiment of a profile in a wall element according to the invention;

FIGS. 3*a* and 3*b* shows detail views of a second embodiment of a profile in a wall element according to the invention;

FIG. 4 shows a schematic view of an embodiment of the method for manufacturing a wall element according to the invention; and FIG. 5 shows a schematic view of an embodiment of the method for constructing a prefab building according to the invention.

In an embodiment (see FIG. 1*a*) wall element 2 is constructed from plane-like layer 4 which is provided with peripheral edge 6. Layer 4 is constructed for the most part from casting mortar G and is provided with profiles 8 which are at least partially incorporated in layer 4.

This embodiment shows a distinction between transverse profiles 10, 12 which extend over width B of wall element 2 and longitudinal profiles 14, 16 which extend in this embodiment over almost the whole length L of wall element 2. Together, transverse profiles 10, 12 extending in first direction y and longitudinal profiles 14, 16 extending in second direction z form part of frame 18. Frame 18 extends along large parts of peripheral edge 6 of wall element 2. Each of the profiles 14, 16 is embedded at least partially in the casting mortar G of layer 4 and is provided with a respective connecting surface 24, 26 (see also FIGS. 2 and 3A). The connecting surfaces 24, 26 are connectable to other parts of a building, such as a floor or an upright 28. Each of the profiles 10, 12 is likewise embedded at least partially in the casting mortar G of layer 4 and is provided with a respective connecting surface (not shown). These connecting surfaces are likewise connectable to another part of a building, such as a floor, or to cross beams.

As seen in third direction x, which lies perpendicularly of surface V of layer 4, the respective connecting surfaces 24, 26 protrude (in direction x) relative to surface V. If connected to connecting surfaces 24, 26, uprights 28 hereby do not come into contact with layer 4.

Wall element 2 is further provided with pressure reducing elements 30, 32 which are connected operatively to layer 4 and are connected to profiles 10, 12, 14, 16. In this embodiment pressure reducing elements 30, 32 are formed from a rubber element. Other elastic materials can however also be envisaged.

As can be seen in FIGS. 1*b* and 1*c*, the connection between casting mortar G of layer 4 and one or more profiles 8 can take diverse forms. In a (non-limitative) embodiment transverse profile 10, 12 can be a U-shaped profile 10, 12

(see FIG. 1*b*). In this case pressure reducing element 30, 32 is arranged on outer end 10*a*, 12*a* of profile 10, 12 and is cast into casting mortar G of layer 4 therewith. Pressure reducing element 30*a*, 32*a* shown here can be arranged on base 10*b*, 12*b* of profile 10, 12, but is optional.

In another (non-limitative) embodiment transverse profile 10, 12 can be a C-profile 10, 12 (see FIG. 1*c*) into which longitudinal profile 14, 16 is placeable. In this embodiment longitudinal profile 14, 16 is adapted to be received substantially fittingly in transverse profile 10, 12. Pressure reducing element 30, 32 is arranged between outer end 10*a*, 12*a* of transverse profile 10, 12 and (in this embodiment bent) part 14*a*, 16*a* of longitudinal profile 14, 16. Parts 10*a*, 12*a*, 14*a*, 16*a* are all cast into casting mortar G of layer 4.

Pressure reducing element 30*a*, 32*a* shown here can be arranged on base 10*b*, 12*b* of profile 10, 12, but is optional.

It is otherwise the case that it is also possible to manufacture wall element 2 as shown in the figures without the presence of pressure reducing elements 30, 32 (and/or pressure reducing elements 30*a*, 32*a*). When interpreting the figures, it should therefore be understood that these elements can be dispensed with.

It is otherwise also possible to opt for a plurality of pressure reducing elements at each connection of a longitudinal profile to a transverse profile.

Profiles 8 can be given different forms (see also FIGS. 2, 3). In another embodiment (see FIG. 2) profile 8, which can be both a transverse profile 10, 12 and a longitudinal profile 14, 16, can have a substantially trapezoidal profile. A longitudinal profile is shown in this case. The base of the trapezoid is provided here with two outward-directed base parts 40. The trapezoid part comprises inclining walls 42 and connecting part 24, 26 which protrudes outside layer 4. In this embodiment connecting part 24, 26 is connected to first side 28*a* of upright 28 by means of connecting means 46 in the form of a screw connection. Other connections are however also possible.

In this embodiment and seen in direction x, inclining walls 42 are provided roughly in the centre thereof with openings 48 through which reinforcement 50 has been inserted. In this embodiment reinforcement 50 takes the form of rod-like reinforcement 50 which extends parallel to the surface V of layer 4 over a predetermined length LW.

In this embodiment (see FIG. 2) wall element 2 is further provided with strengthening element 52 in the form of grating 52 which extends in layer 4 substantially parallel to surface V of layer 4. Grating 52 preferably extends in layer 4 both in first direction y and in second direction z.

In this embodiment grating 52 is connected to reinforcement 50 by means of interweaving, creating an integral structure which imparts a high strength to layer 4 and also provides a good connection between profile 8 and layer 4.

Second side 28*b* of upright 28 can be finished with a finishing wall (not shown), such as for instance wooden boards or plasterboards.

In another embodiment (see FIG. 3) profile 8 can be a C-profile provided with two corner parts 54, 56 and base part 58. In this embodiment corner part 54 is embedded in layer 4. Corner part 54 is further provided with openings 48 which extend through profile 8 and in which, in this case rod-like, reinforcement 50 is arranged. Also provided in wall element 2 in this embodiment is strengthening element 52, which extends in layer 4 substantially parallel to surface V of layer 4 in both first direction y and second direction z. In this embodiment reinforcement 50 and strengthening element 52 are interwoven.

In the shown embodiment (see FIG. 3A) corner part 56 can be connected to a finishing wall (not shown), such as for instance wooden boards or plasterboards. In a further embodiment (see FIG. 3B) corner part 56 can also be incorporated in second layer 60 in the same way. This layer can also be formed from casting mortar G, optionally provided with reinforcement 62 and/or strengthening element 64.

In an embodiment of method 1000 for manufacturing a wall element according to the invention (see FIG. 4) method 1000 comprises the steps of providing 1002 a number of profiles and connecting 1004 the profiles in order to form a frame.

The method further comprises the step of arranging 1006 during the connecting at least one pressure reducing element between the profiles and the step of pouring 1008 casting mortar in order to form a layer, wherein the profiles of the frame are at least partially embedded in the layer and are provided with at least one connecting surface which is positioned outside the layer, as seen from a layer surface.

Method 1000 can optionally comprise various other (sub-) steps. The step of providing 1002 the profiles can thus comprise the step of manufacturing 1010 profiles from steel, such as stainless steel.

Other additional steps in method 1000 which are shown in this embodiment (see FIG. 4) are the optional steps of arranging 1012 a strengthening element in the layer and arranging 1014 reinforcement in the layer, wherein the arranging comprises of connecting the reinforcement to the profiles and/or the strengthening element prior to the pouring.

A further optional step in method 1000 which is shown in this embodiment (see FIG. 4) is the step of connecting 1018 one or more upright elements to the connecting surfaces. Combinations of the different optional steps are also possible.

In an embodiment of a method 2000 for manufacturing a wall element according to the invention (see FIG. 5) method 2000 comprises the steps of providing 2020 a plurality of wall elements according to the invention or a number of walls according to the invention, placing 2022 the wall elements or walls on a floor or foundation and placing 2024 a roof construction.

Method 2000 can optionally comprise various other steps, which are likewise shown in this embodiment. This comprises for instance the step of placing 2026 a storey floor and placing wall elements or walls on the storey floor in order to form a storey and/or the step of arranging 2028 insulating material and/or a moisture-proof and/or moisture-regulating layer against the layer on the side of the at least one connecting surface of the one or more profiles.

Other optional steps which are shown (see FIG. 5) are for instance the step, if the wall to be formed forms an outer wall of the building, of directing 2030 the layer toward the outer side of the building prior to the placing and/or providing 2032 a second layer which is directed toward an inner side of the building to be constructed and which extends parallel to the first layer, and which is connected to the one or more profiles or, alternatively, to the one or more uprights.

The present invention is by no means limited to the above described preferred embodiments thereof. The rights sought are defined by the following claims, within the scope of which many modifications can be envisaged.

The invention claimed is:

1. Wall element for manufacturing a wall of a structure, comprising:

a substantially plane-like layer with a peripheral edge, wherein the layer comprises casting mortar;

a plurality of profiles which are at least partially embedded in the layer and which are provided with at least one connecting surface which is positioned outside the layer, wherein the plurality of profiles comprises at least two longitudinal profiles that extend over a whole length of the wall element and two transverse profiles that extend over a whole width of the wall element, wherein the two longitudinal and the two transversal profiles form a frame that extends along the peripheral edge of the layer; and at least one pressure reducing element which is operatively connected to at least a part of the plurality of profiles, wherein at least one of the at least one pressure reducing element is arranged on an outer end of a profile of the plurality of profiles and is cast into the casting mortar of the plane-like layer, and wherein the pressure reducing element is configured to absorb the pressure differences between the casting mortar of the layer and the plurality of profiles, wherein the at least one pressure reducing element is an elastic element that is more elastic than the casting mortar and the plurality of profiles.

2. Wall element according to claim 1, wherein the pressure reducing element is configured to absorb pressure differences caused by differences in expansion coefficient.

3. Wall element according to claim 1, wherein the plurality of profiles further comprises:

a sub-group of longitudinal profiles which extend over at least a part of a length of the wall element; and a sub-group of transverse profiles which extend over at least a part of a width of the wall element.

4. Wall element according to claim 3, wherein the pressure reducing element is arranged between the sub-group of longitudinal profiles and the sub-group of transverse profiles at a position where the sub-group of longitudinal profiles and the sub-group of transverse profiles connect to each other.

5. Wall element according to claim 1, further comprising one or more upright elements, wherein each upright element is associated with a profile and extends along the at least one connecting surface thereof.

6. Wall element according to claim 1, wherein the layer further comprises a strengthening element which extends in the casting mortar, wherein the strengthening element is a mesh and/or wherein the strengthening element is manufactured from plastic or from metal.

7. Wall element according to claim 1, further comprising a reinforcement which extends at least partially in the layer and which is connected to at least a part of the profiles or is incorporated at least partially therein.

8. Wall element according to claim 7, wherein the reinforcement can be formed by rod-like elements which extend substantially perpendicularly of a longitudinal direction of the profiles.

9. Wall element according to claim 7, wherein the layer further comprises a strengthening element which extends in the casting mortar, and wherein the reinforcement is connected to the strengthening element.

10. Wall element according to claim 5, wherein the connecting surface has a shaped profile or wherein the connecting surface is provided with a central recess in which the upright is placeable.

11. Wall element according to claim 1, further comprising:

a second substantially plane-like layer with one or more side edges, wherein the second layer extends substantially parallel to the first layer, wherein the second layer comprises casting mortar;

one or more profiles which are at least partially embedded in the second layer and which are provided with at least one connecting surface which is positioned outside the plane-like surface of the second layer; and at least one second pressure reducing element which is operatively connected to at least a part of the one or more profiles of the second layer.

12. Wall comprising a number of wall elements according to claim 1.

13. Building comprising a number of walls according to claim 12.

14. Method for manufacturing a wall element according to claim 1, the method comprising the steps of:

providing the plurality of profiles;

connecting the profiles in order to form the frame;

arranging the at least one pressure reducing element between the profiles during the connecting; and pouring the casting mortar in order to form the layer, wherein the profiles of the frame are at least partially embedded in the layer and are provided with the at least one connecting surface which is positioned outside the layer.

15. Method for constructing a prefab building, the method comprising the steps of:

providing a plurality of wall elements according to claim 1;

placing the wall elements or walls on a floor or foundation, wherein the at least one pressure reducing element of each wall element is positioned on an underside of the wall elements or wall to be placed; and placing a roof construction.

16. Method according to claim 15, the method further comprising at least one of the following steps:

placing a storey floor and placing wall elements or walls on the storey floor in order to form a storey;

directing the layer toward the outer side of the building prior to placing if the wall to be formed forms an outer wall of the building;

providing a second layer which is directed toward an inner side of the building to be constructed and which extends parallel to the first layer, and which is connected to the one or more profiles or, alternatively, to the one or more uprights; and arranging insulating material and/or a moisture-proof and/or moisture-regulating layer against the layer on the side of the at least one connecting surface of the one or more profiles.

* * * * *